US005974812A

United States Patent [19]

Kátai et al.

[11] Patent Number: 5,974,812

[45] Date of Patent: Nov. 2, 1999

[54] METHOD AND DEVICE FOR COOLING

[76] Inventors: Lajos Kátai, Rákóczi u.24, Budapest, Hungary, H-1161; Lajos Kátai, Jr., Köszikla u. 13, Budaörs, Hungary, H-2040; Zoltán Kátai, Rákóczi u. 24, Budapest, Hungary, H-1161

[21] Appl. No.: 09/000,010

[22] PCT Filed: Jul. 28, 1995

[86] PCT No.: PCT/HU95/00038

§ 371 Date: Jan. 21, 1998

§ 102(e) Date: Jan. 21, 1998

[87] PCT Pub. No.: WO97/05434

PCT Pub. Date: Feb. 13, 1997

[51] Int. Cl.[6] ..... F25B 43/00; F25D 17/02

[52] U.S. Cl. ..... 62/118; 62/174; 62/512; 62/DIG. 2

[58] Field of Search ..... 62/115, 512, DIG. 2, 62/118, 174

[56] References Cited

U.S. PATENT DOCUMENTS

| | | | |
|---|---|---|---|
| 2,133,948 | 10/1938 | Buchanan | 62/512 X |
| 2,185,515 | 1/1940 | Neeson | 62/DIG. 2 X |
| 2,389,106 | 11/1945 | Marshall et al. | 62/118 X |

*Primary Examiner*—William Wayner
*Attorney, Agent, or Firm*—Kenyon & Kenyon

[57] ABSTRACT

A vapor compression system having a compressor, condenser, receiver, evaporator, two liquid refrigerant tanks, a phase separator and a liquid refrigerant heat exchanger. The liquid refrigerant is pumped alternatively from one of the tanks through the heat exchanger using controlled valving such that there is no phase change and gaseous refrigerant is withdrawn by the compressor from the top of the phase separator.

20 Claims, 3 Drawing Sheets

METHOD AND DEVICE FOR COOLING

TECHNICAL FIELD

The present invention relates to a novel cooling method and to a device for cooling a circulated liquid coolant, in a quasi-continuous mode of operation by means of its limited expansion, especially for performing the above method in a cooling apparatus or in cooling plants including the device.

BACKGROUND ART

In known refrigerators, the temperature of spaces or products stored in such spaces is reduced by using a cooling cycle through which an evaporable liquid coolant is circulated. The liquid coolant is introduced in at least one evaporator in which the coolant is evaporated at constant pressure and temperature. Accordingly, the heat content of the spaces or products to be refrigerated is always reduced by mere evaporation of the liquid coolant. This applies even to cases where the temperature of the spaces or goods to be cooled has to be reduced significantly. In such cases, the large temperature difference in the heat exchange performed results in loss of energy and thus, in poor efficiency.

According known measures that have been in use in the technical field concerned, in cases where the temperature of the spaces or goods to be cooled has to be reduced significantly, the energy consumption of the refrigerators applied can be reduced significantly by cooling performed at varying temperatures and/or by pre-cooling the liquid coolant to or at least near to its temperature of evaporation.

Hungarian Patent Specification No. 201141 discloses a method and a device for performing the same, where for reducing the energy consumption of refrigerators the condensed liquid coolant is introduced, for the purpose of its limited expansion, from a liquid collector of the device in a liquid recipient from which the expanding vapour phase of the coolant is being continuously removed by means of a piston-type reciprocating displacement pump. The vapour phase removed is being reintroduced in the path of flow of the circulated coolant at a location between a condenser and a compressor of the refrigerator. This results in that the amount of liquid coolant contained in the liquid recipient is cooled down, by means of limited expansion, to temperature values that are equal or at least near to the temperature of evaporation of the liquid coolant, and the cooled liquid coolant is introduced in the path of flow of the circulated coolant for evaporation. Since upon passing the throttle or feed valve arranged prior to the evaporator a liquid coolant the temperature of which is higher than the temperature of evaporation would always cool down without the reduction of its enthalpy that is associated with great losses of energy, by introducing a cooled liquid coolant in the cooling cycle as disclosed in the Hungarian Patent Specification No. 201141, considerable savings of energy can be realized.

Besides its significant advantages, the known method and apparatus according to Hungarian Patent No. 201141 show a number of shortcomings, too. The liquid coolant looses its pressure while passing the cooling device, and its pressure will be substantially corresponding to its low temperature. Because of this, either the use of a booster pump becomes necessary for its reintroduction in the cooling cycle, or the cooling has to be terminated well before reaching the temperature of evaporation. In addition to this, a liquid collector of enlarged volume has to be foreseen and used in the device because of the necessity of storing, at least temporarily, the liquid coolant content of the liquid recipient during its discharging. Finally, in contrast to conventional ones, larger capacity feed valves are needed for operation because of the reduced temperature difference upon coolant introduction.

The principal object of the invention is to provide an improved cooling method of reduced energy consumption whereby any known cooling apparatus that also includes a device for cooling a circulated liquid coolant, in a quasi-continuous mode of operation by means of its limited expansion, can be operated at improved economics.

Another object of the invention is to provide an improved device for cooling a circulated liquid coolant by means of its limited expansion that would, due to improved process control and changes in design, be free of the shortcomings of the known device referred to further above.

It has been discovered that by combining the possibility of continuously producing a cooled supply of coolant in a refrigeration plant with the fact that the efficiency and thus, the energy consumption of a cooling process depends, with high significance, on the temperature difference of the cooling process, an improved utilization of the liquid heat content of the cooled liquid coolant can be realized for reducing, in an energy saving manner and at least initially, the relatively high temperature of spaces or products to be cooled.

DISCLOSURE OF THE INVENTION

The above and other objects are achieved by the provision of a method for reducing, in an energy saving manner, the temperature in confined spaces or of products stored in such spaces, by circulating and quasi-continuously cooling an evaporable liquid coolant by means of its limited expansion, in an apparatus comprising, within the path of an induced flow of an evaporable liquid coolant, at least one compressor, a condenser, a liquid collector and at least one evaporator. The apparatus also includes at least one precooling compartment and a device for cooling the liquid coolant by means of its limited expansion. The device has a vapour inlet that is connectable to an admission inlet of the at least one compressor, and a liquid outlet that is, directly and/or indirectly, connectable to a liquid coolant inlet of the at least one evaporator. According to the invention, the method is characterized in utilizing for cooling, at least temporarily, the cooled liquid coolant as a liquid heat carrier, by causing at least a partial amount of the coolant to flow, by maintaining its liquid state, i.e. without evaporation, through at least one heat exchanger that is arranged in direct heat exchanging relation to the at least one precooling compartment of the apparatus.

Within the scope of the present invention, an improved device that can easily be associated with practically all types of known refrigerating plants, is provided for. The device comprises liquid recipients and a preferably piston-type reciprocating positive displacement pump an admission inlet of which is, via a phase separator, connectable to said liquid recipients, and a delivery outlet of which is connected to the vapour receiving upper space of a condenser while the liquid containing lower space of the condenser is connected to a liquid collector. The device further comprises closing valves, pressure controlled check valves, liquid level detectors and temperature gauges for controlled automatic operation. According to the invention, the device comprises two identical liquid recipients of preferably vertically elongated shape and parallel arrangement. The upper inner space sections of the recipients are, via controlled closing valves, alternately connectable to an upper vapour phase section of the phase separator, that is also connected, via a controlled closing valve to a collector conduit of the liquid collector. The upper inner space sections of the liquid recipients are, via further controlled closing valves, also alternately connectable to a common supply conduit which in turn is, via a preferably three-way changeover valve, also connected to the collector conduit of the liquid collector. The lower inner space sections of the liquid recipients are connected, alternately again, via check valves, to a common discharge conduit that leads to a cooled liquid outlet of the device. The liquid recipients are further and alternately connected, via further check valves, to a lower liquid phase section of the phase separator, and an uppermost vapour outlet of the phase separator is in permanent connection with an admission conduit of the at least one reciprocating positive displacement pump while the admission conduit is further connected, via a check valve, to a vapour inlet of the device. The discharge outlet of the at least one reciprocating positive displacement pump is connected either directly or via a check valve to a delivery conduit of the condenser, or via a controlled closing valve, to a delivery conduit of a lower stage compressor of a conventional two stage cooling apparatus and, via a check valve to both, the delivery conduit of the condenser and the delivery outlet of a higher stage compressor of the cooling apparatus. In the device according to the present invention the common discharge conduit of the liquid recipients is also connected, via a coolant pump, a heat exchanger, and a controlled closing valve, to the preferably three-way changeover valve so that in typical modes of operation, the positive circulation of the liquid coolant within the device is allowed for.

Preferred embodiments of the device further comprise an intermediate liquid storage vessel of preferably vertically elongated shape, an upper inner space section of which is connected to the collector conduit of the liquid collector while a bottom space section of the vessel is connected, via a branch conduit, to the path of flow of the liquid coolant at a location between the at least one heat exchanger and the three-way changeover valve. The intermediate liquid storage vessel is equipped with at least one temperature gauge for its automatic operation.

In still preferred embodiments of the device according to the present invention the liquid recipients are equipped with inside means for inducing and maintaining an increased circulation of the liquid coolant in the respective liquid recipient during its cooling by limited expansion. Said means includes at least one space separating wall portion whereby at least one rise duct for the upward flow, and at least one gradient duct for the downward flow of the coolant in the inner space of each liquid recipient is substantially provided for.

BRIEF DESCRIPTION OF THE DRAWINGS

Further characteristic features, preferred modes of operation and certain advantages of the invention will be readily and more clearly understood by the following detailed description of preferred embodiments of the invention shown, by way of examples only, in the attached drawing figures, wherein.

DESCRIPTION OF THE PREFERRED EMBODIMENTS AND MODES OF OPERATION

Figure 1:
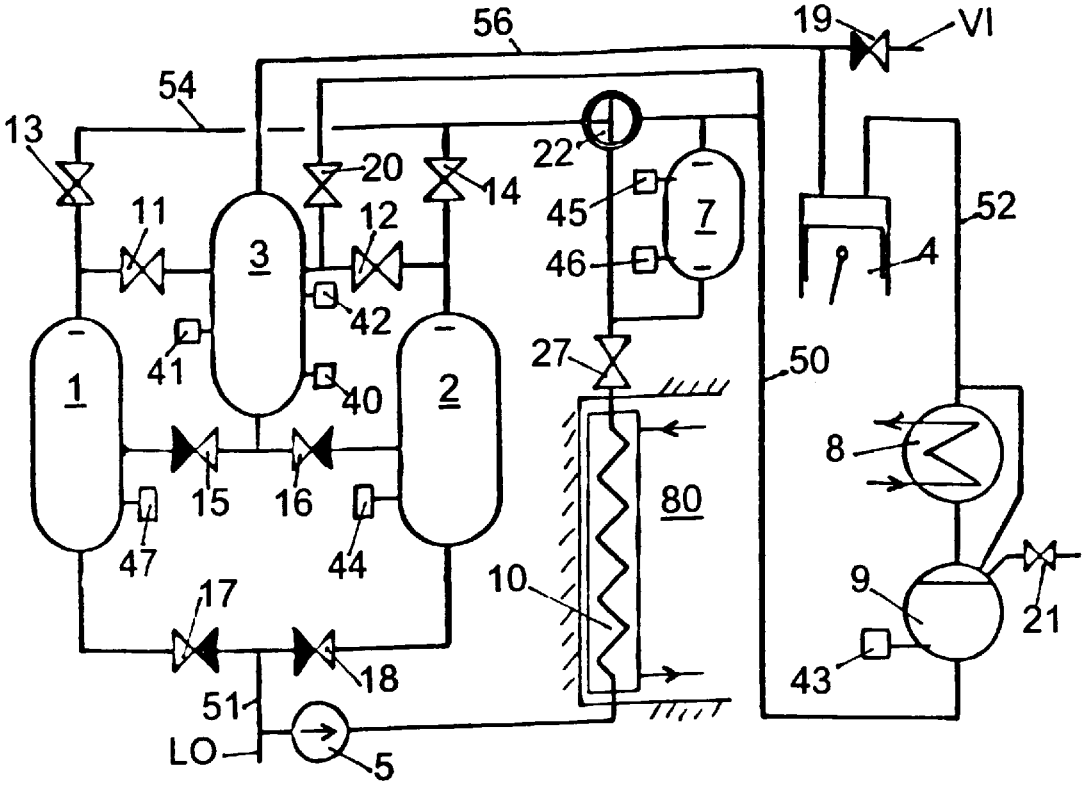
FIG. 1 is a diagrammatic layout of one preferred embodiment of the improved device for cooling a circulated liquid coolant, in a quasi-continuous mode of operation by means of its limited expansion.

The embodiment of the improved device shown in FIG. 1 of the attached drawing by way of example only, comprises for cooling a circulated liquid coolant, in a quasi-continuous mode of operation by means of its limited expansion, liquid recipients 1 and 2. The liquid recipients 1, 2 may, in preferred embodiments of the device, also include additional inside means (not shown in FIG. 1. and to be described later) for inducing and maintaining an increased circulation of the liquid coolant within said liquid recipients 1, 2 during its cooling mode of operation. The device of FIG. 1 further comprises a piston-type reciprocating positive displacement pump 4 an admission inlet of which is, via a phase separator 3, connectable to the liquid recipients 1, 2, and a delivery outlet of which is connected to a vapour receiving upper space of a condenser 8. A lower, liquid coolant containing space of the condenser 8 is in permanent connection with a liquid collector 9. The device further comprises closing valves 11–14, 20, 21, 24, 26–29, pressure controlled check valves 15–19, 23, 25, liquid level detectors 40–43 and temperature gauges 44–47 by which a controlled automatic operation of the device is performed. As shown in FIG. 1, the two identical liquid recipients 1 and 2 having the shape of a vertically elongated body of rotation are in parallel arrangement. Their upper inner space sections are, via controlled closing valves 11 or 12, alternately connectable to an upper vapour phase section of the phase separator 3, that is also connected, via a controlled closing valve 20 to a collector conduit 50 of the liquid collector 9. The upper inner space sections of the liquid recipients 1, 2 are, via further controlled closing valves 13 or 14, also alternately connectable to a common supply conduit 54 which in turn is, via a three-way changeover valve 22, also connected to the collector conduit 50 of the liquid collector 9. The lower inner space sections of the liquid recipients 1, 2 are connectable, alternately again, via check valves 17 or 18 to a common discharge conduit 51 that leads to a cooled liquid outlet LO of the device. The liquid recipients 1, 2 are further and alternately connectable, via further check valves 15 or 16, to a lower liquid phase section of the phase separator 3, and an uppermost vapour outlet of the phase separator 3 is permanently connected to an admission conduit 56 of the reciprocating positive displacement pump 4. The admission conduit 56 is further connected, via a check valve 19, to a vapour inlet VI of the device. In the preferred embodiment of the device shown in FIG. 1, the discharge outlet of the reciprocating positive displacement pump 4 is directly connected to a delivery conduit 52 of the condenser 8. The common discharge conduit 51 of the liquid recipients 1, 2 is also connected, via a coolant pump 5, a heat exchanger 10, and a controlled closing valve 27, to the three-way changeover valve 22 whereby at least in typical modes of operation, the positive circulation of the liquid coolant by maintaining its liquid state, i.e. without evaporation, is allowed for. In such modes of operation the temperature of the cooled liquid coolant will increase gradually because it is repeatedly introduced and flown through the heat exchanger 10 in which its "cool content" is, preferably in counter-flow, transferred to and thus, utilised for cooling a precooling compartment 80 or certain products stored therein. The embodiment of the device shown in FIG. 1 also comprises an intermediate liquid storage vessel 7. An upper inner space section of the vessel 7 is connected to the collector conduit 50 of the liquid collector 9, while a bottom space section of the vessel 7 is connected, via a branch conduit 55, to the path of flow of the liquid coolant at a location between the heat exchanger 10 and the three-way changeover valve 22. The intermediate liquid storage vessel 7 is equipped with temperature gauges 45 and 46. The intermediate liquid storage vessel 7 has the shape of a vertically elongated body of rotation, and it has a bottom in/outlet and an upper in/outlet for the liquid coolant. The in/outlets are arranged in axial alignment with the vertical axis of the vessel 7 which, at least in preferred embodiments, also comprises built-in deflecting plates which, when the device is in operation, prevent the rapid mixing of the flowing-in liquid coolant with the liquid already contained in the vessel 7. The deflecting plates are arranged inside the vessel 7 in the near proximity of both, the bottom in/outlet and the upper in/outlet in axial alignment with the vertical axis of the vessel 7. In the device as shown in FIG. 1, for the purpose of its controlled automatic operation to be described later, the liquid recipients 1 and 2 are also equipped with respective temperature gauges 47 and 44, and the liquid separator 3 is equipped with liquid level detectors 40 and 41. Since for the operation of the device in both, the phase separator 3 and the liquid collector 9 a minimum level and a maximum level of the liquid coolant has to be maintained respectively, said units of the device are also equipped with respective emergency liquid level detectors 42 and 43. It seems to be of importance to mention that for the purpose of better understanding, in all embodiments of the invention illustrated in the attached drawing figures, only units and component parts of the device that are functionally inevitable for operation are shown. Embodiments of the present invention that are designed for practical use should always be equipped with further control and safety means that would ensure the smooth and safe operation of the device, and the apparatus including the same.

In the following, the quasi-continuous mode of operation of the device shown in FIG. 1 is described in a more detailed manner. Within the scope of the present specification and the attached claims, the term quasi-continuous mode of operation is intended to mean that though the liquid coolant contained in the liquid recipients 1 and 2 is being intermittently and inversely either cooled by means of its limited expansion, or circulated within the system for the purpose of utilizing its low temperature for cooling through preferably counter-flow heat exchange with at least one cooling compartment or products that are stored therein, the above mentioned two opposite operational phases are performed alternately in the liquid recipients 1, 2, and due to automatically controlled sequential push-pull type switch-overs between the intermittent opposite operational phases in the liquid recipients 1, 2, a permanent, practically continuous supply of cooled liquid coolant is present in the discharge conduit 51 and thus, at the liquid outlet LO of the device.

For the purpose of describing the operation of the device shown in FIG. 1, first it is assumed that the controlled closing valves 11 and 14 are in their open, thoroughfare state while closing valves 12 and 13 are closed. The liquid recipient 2 contains cold liquid coolant that has been duly cooled during its preceding operational phase, and the cold liquid coolant is circulated by the coolant pump 5 along a path of flow through the heat exchanger 10, the open closing valve 27, the three-way changeover valve 22 that is in its state as shown in FIG. 1, back into the liquid recipient 2. The liquid state of the coolant is maintained all along the above closed cycle. The temperature of the liquid coolant becomes however, gradually higher since it is exposed during its circulation, to direct, preferably counter-flow heat exchange with the space of higher temperature of the precooling compartment 80 therein, in the course of which the "cold content" of the cooled liquid coolant is transferred to the space or products to be cooled/precooled. It seems to be important to mention that the novel characteristic feature of the method according to the present invention, namely the utilization of at least a partial amount of the cooled liquid coolant for cooling through heat exchange without evaporation is already performed, in one particular way, in the course of the above described mode of operation.

Simultaneously with the above, the amount of liquid coolant of initially higher temperature that is contained in the liquid recipient 1 and has been used, by circulation and heat exchange for cooling in the preceding operational phase, is being cooled by expanding into the phase separator 3 the upper vapour space section of which is permanently connected to the suction side of the reciprocating displacement pump 4. A partial amount of the cooled liquid coolant flows, through the open check valve 15 back into the liquid recipient 1 whereby its liquid coolant content is gradually cooled to the required low temperature. During the above described operational phase the check valve 15 is open while check valve 16 is closed, since the inner space of the liquid recipient 1 is under a lower pressure than that of the liquid recipient 2 in which the inner pressure is identical with the highest possible pressure within the device, such highest pressure always prevailing in the condenser 8. Due to the same pressure conditions, check valve 17 is closed while check valve 18 is open during the above operational cycles of the liquid recipient 1.

As the temperature gauge 44 of the liquid recipient 2 is actuated by the liquid coolant the temperature of which is gradually increasing while said coolant is, as a liquid state heat carrier i.e. without evaporation, recirculated through the heat exchanger 10 to the liquid recipient 2, a control signal for closing the closing valve 11 and opening the closing valves 12 and 20 is produced. As a consequence of this, the cooled liquid coolant contained in the phase separator 3 will, via the check valve 15, flow over into the liquid recipient 1, and as the level of the liquid coolant that flows into said phase separator 3 from the liquid collector 9 through the closing valve 20 reaches the liquid level detector 40, another control signal closes the closing valves 20 and 14 and opens the closing valve 13. Caused by the change of the pressures prevailing in the different units and component parts of the device, check valves 15 and 18 will close while the check valves 16 and 17 open and become thoroughfare for the liquid coolant. From now on, the liquid coolant that has been cooled during the preceding operational phase of the liquid recipient 1 will be circulated by the coolant pump 5 through the heat exchanger 10, while the warm liquid coolant content of the liquid recipient 2 is being cooled again by its expansion and by delivering its expanding vapour phase from the phase separator 3 into the condenser 8 by the displacement pump 4. As now the temperature gauge 47 of the liquid recipient 1 is actuated by the liquid coolant the temperature of which is gradually increasing while it is, as a liquid state heat carrier i.e. without evaporation again, recirculated through the heat exchanger 10 to the liquid recipient 1, another control signal is produced, whereby another push-pull type switch-over between the above intermittent and opposite operational phases of the liquid recipients 1, 2 occurs.

An improved, possibly full-extent utilization of the "heat" content of the cooled liquid coolant can be achieved by making use of the intermediate liquid storage vessel 7 of the device. The intermediate liquid storage vessel 7 plays the role of a balancing recipient in the device wherein a varying excess amount of liquid coolant is stored temporarily. The amount and the temperature of the coolant stored always depends on the prevailing conditions of system operation. By using the three-way changeover valve 22, the liquid coolant content, if cold enough, can also be utilized for cooling by also involving, at least from time to time and in additional, intermediate operational phases of the device prior to the above described push-pull type switch-overs between the above described phases of operation, the intermediate liquid storage vessel 7 and its cold coolant content in the path of positive circulation of the liquid coolant through the heat exchanger 10 and any one of the liquid recipients 1 or 2. Hereby is ensured that first an amount of liquid coolant of lower temperature will enter the respective liquid recipient 1 or 2, and this is followed by the entry of the liquid of ambient temperature on the top of the liquid already contained therein.

Figure 2:
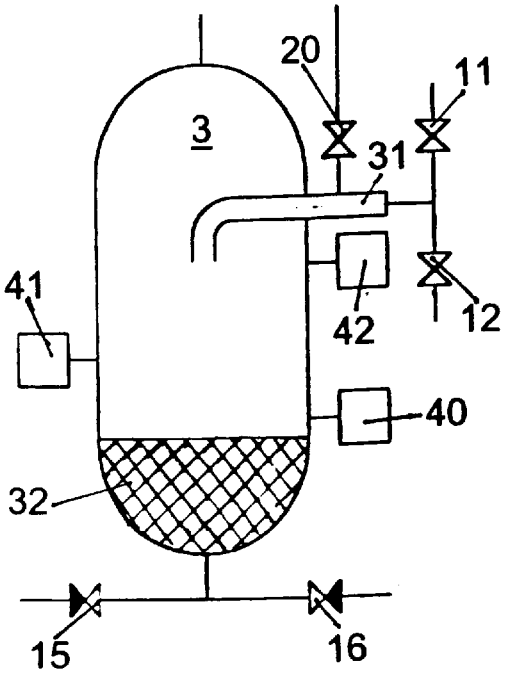
FIGS. 2 and 3 are enlarged elevations of preferred embodiments of the phase separator of the device of FIG. 1.
Figure 3:
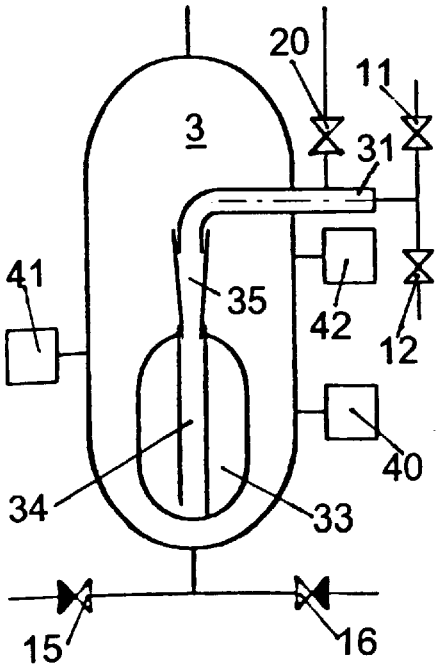

FIGS. 2 and 3 show preferred alternative embodiments of the phase separator 3 of the device shown in FIG. 1 and described above.

FIG. 2 depicts a phase separator 3 of controlled liquid level and the shape of a vertically elongated body of rotation. The phase separator 3 is equipped with liquid level detectors 40, 41 and further comprises, in its lower liquid phase section, a packing 32 of Raschig rings for preventing the rapid mixing of the charging-in coolant with the liquid already contained therein.

FIG. 3 shows an alternative embodiment of a similarly shaped and level controlled phase separator wherein a means for preventing the rapid mixing of the charging-in coolant with the liquid already contained therein comprises an inside vessel 33 an upper inlet of which is equipped with a siphon pipe 34 that protrudes, down to a location near the vessel bottom, into the inside vessel 33. The means also comprises a funnel piece 35 that is arranged between a discharge opening of a charge conduit 31 and the upper inlet of the inner vessel 33 in axial alignment with the vertical axis of the phase separator 3.

Figure 4:
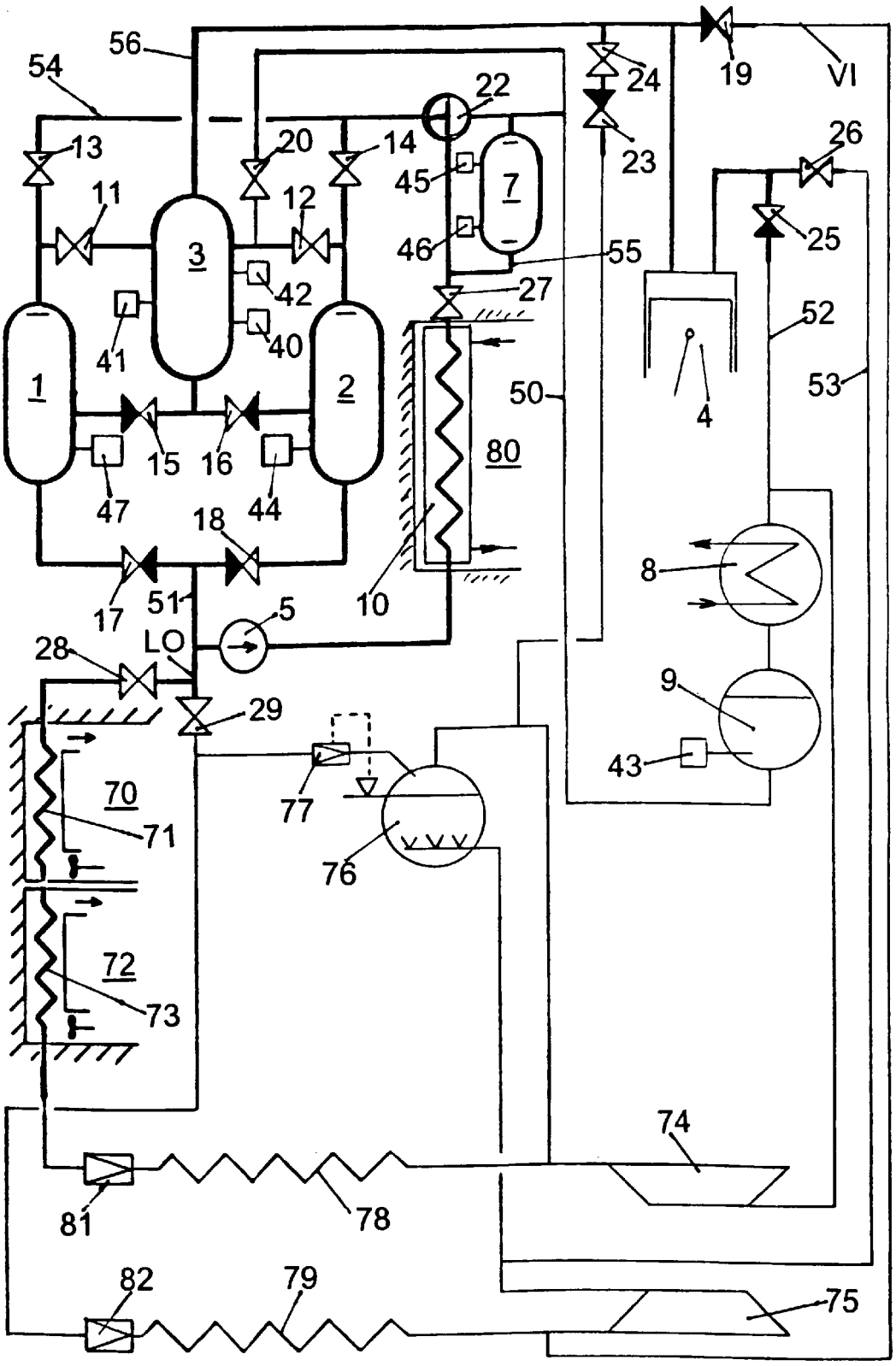
FIG. 4 is a diagrammatic layout of a cooling apparatus that is suitable for performing the method according to the invention by utilizing the preferred embodiment of the device shown in FIG. 1, and FIGS. 5 to 10 are enlarged elevations of preferred embodiments of the liquid recipients of the device of FIG. 1, the liquid recipients being equipped with a means for inducing and maintaining an increased circulation of the liquid coolant contained therein.
Figure 5:
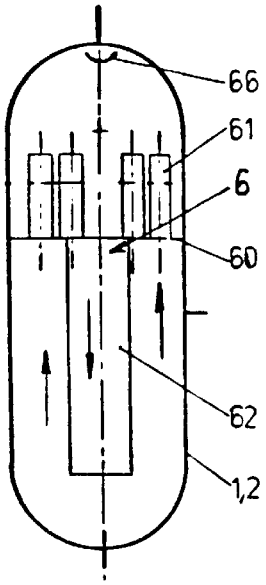
Figure 6:
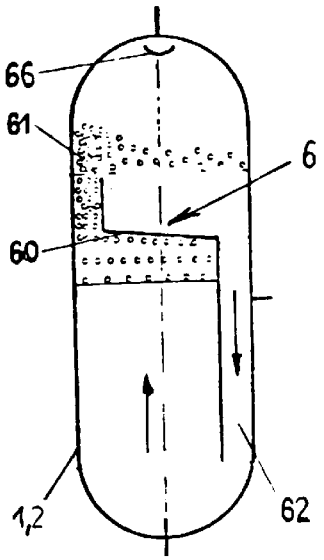
Figure 7:
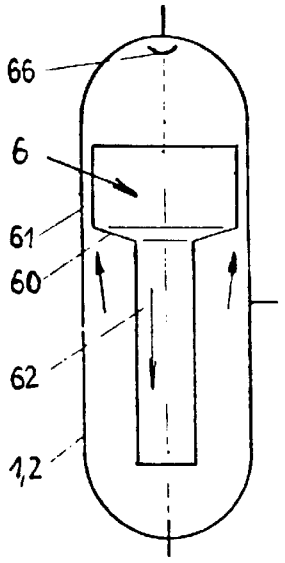
Figure 8:
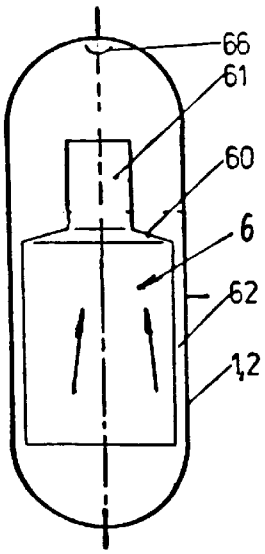
Figure 9:
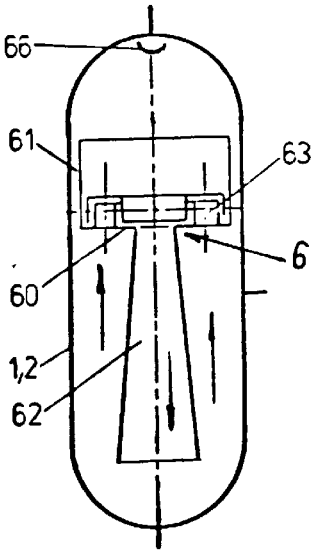
Figure 10:
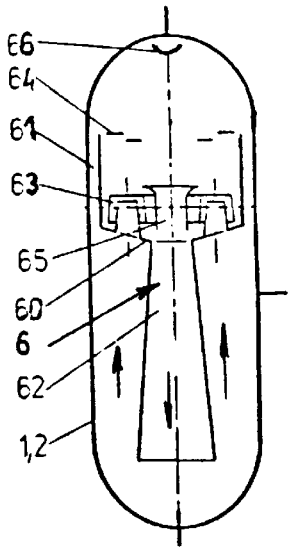

FIG. 4 of the attached drawing shows, by way of another example only, the diagrammatic layout of a two-stage cooling apparatus that is capable of fully performing all alternatives of the energy saving cooling method according to the present invention. The coolant circulating cycle of the apparatus includes in full, the improved device (shown in FIG. 1) for cooling a circulated liquid coolant in a quasi-continuous mode of operation by means of its limited expansion. In the cooling apparatus of FIG. 4 however, the discharge outlet of the reciprocating positive displacement pump 4 is connected via a check valve 25 to the delivery conduit 52 of the condenser 8. Said discharge outlet of the displacement pump 4 is, via a controlled closing valve 26, also connectable to a delivery conduit 53 of a lower stage compressor 75 of the apparatus and, via a check valve 25 to both, the delivery conduit 52 of the condenser 8 and the delivery outlet of an upper stage compressor 74. Further units and component parts of the apparatus shown in FIG. 4 are heat exchangers 71 and 73 that are in direct, preferably counter-flow heat exchanging relationship with precooling compartments 70 and 72, respectively. The heat exchangers are connectable, via a controlled closing valve 28 and in series, between the cold liquid outlet LO of the device shown in FIG. 1 and a throttle or feed valve 81 of an upper stage evaporator 78 of the cooling apparatus. The cold liquid outlet LO of the device for cooling a circulated liquid coolant shown also in FIG. 1 is, via a controlled closing valve 29, also connectable to a throttle or feed valve 82 of a lower stage evaporator 79 and, via a liquid level controller 77, to an intermediate cooler 76 which in turn, is in permanent connection also with the delivery side of the lower stage compressor 75.

For performing different, particular alternatives of the method according to the invention the apparatus shown in FIG. 4 can be operated as follows:

Are the controlled closing valves 24, 28, and 29 maintained in their closed state, only the device shown in FIG. 1 is in operation as described further above, and its full cooling power is used for cooling the precooling compartment 80 through preferably counter-flow heat exchange between the cooled liquid coolant and the compartment 80 by means of the heat exchanger 10 through which the coolant flows, without evaporation, while its induced circulation within the device.

With the closing valve 27 brought and maintained in its open state, the lower stage of the conventional two-stage cooling apparatus wherein the cooling cycle includes the evaporation and the re-condensation of at least a partial amount of the coolant, is also set in operation while the above described cooling by means of the device shown in FIG. 1 is further operated.

In addition to the above, the upper stage of the cooling apparatus is set in operation by bringing the controlled closing valves 24 and 28 in their open, thoroughfare state. By doing so, the amount of cold liquid coolant that is first flown through the series of the heat exchangers 71, 73 will by simultaneous increase of its temperature, transfer an initial part of its heat content, without evaporating, to the precooling compartments 70 and 72, and it will enter, via the throttle or feed valve 81, the upper stage evaporator 78 of the apparatus at a higher temperature that is preferably equal with or at least corresponding to the evaporation temperature of said upper stage of the cooling apparatus shown.

From the above description of the operation of the apparatus it seems to be readily apparent that by suitable process controlling of the interrelations, combinations, and the sequence of the large variety of the possible modes of operation, such a process control involving a large number of temperature gauges and other sensors arranged at different locations within a cooling plant to be operated, the cooling method of reduced power consumption according to the present invention can be performed in a large variety of ways and suitably designed different practical embodiments of the apparatus. The cooling can always be performed by maximum consideration of the(changing) temperature(s) of the spaces or product(s) to be refrigerated.

FIGS. 5 to 10 of the attached drawing show a number of preferred, different embodiments of the liquid recipients 1, 2 that can be used, providing improved efficiency and other advantages, in the device for cooling the circulated liquid coolant according to the present invention. All embodiments shown in FIGS. 5 to 10 include an inside means 6 for inducing and maintaining an increased circulation of the liquid coolant within the liquid recipient 1, 2 during its cooling by limited expansion. In all embodiments, said means 6 comprises at least one space separating wall portion 60 whereby at least one rise duct 61 for the upward flow, and at least one gradient duct 62 for the downward flow of the coolant in the inner space of each liquid recipient 1, 2 is provided for. Means 6 may have a space separating wall portion 60 that is not or only partially connected to the inner wall of the liquid recipient 1, 2, where the at least one rise duct 61 and/or at least one gradient duct 62 is confined, at least partially, by at least one inner wall portion of the liquid recipient 1, 2. In such embodiments, the at least one rise duct 61 and/or at least one gradient duct 62 has, when viewed in cross section, the shape of a circular ring or a sector. The space separating wall portion 60 of means 6 can be equipped, attached to its upper wall surface, with a number of siphon traps 63. In other embodiments, said means 6 may be equipped with at least one vapour baffle plate 64 that is arranged, in a substantially horizontal plane, in the proximity of the upper edge of the at least one rise duct 61. In other embodiments again, the gradient duct 62 may have a duct extension 65 that provides a double inlet for the coolant. In such cases, the duct extension 65 is attached to the gradient duct 62 and protrudes in upward direction from the space separating wall portion 60. Finally, the liquid recipients 1, 2 of the shape of a vertically elongated body of rotation may also comprise built-in deflecting plates for preventing a rapid mixing of the flowing-in liquid coolant with the liquid already contained therein. The deflecting plates should always be arranged in axial alignment with the vertical axis of said body of rotation inside the liquid recipients 1, 2.

List of Reference Signs of the Drawings liquid recipient 1, 2
phase separator 3
displacement pump 4
coolant pump 5
means for inducing and maintaining circulation of the liquid 6
intermediate liquid storage vessel 7
coolant condenser 8
liquid collector 9
heat exchanger 10,71,73
controlled closing valve 11,12,13,14,20,21,24,26,27,28, 29
check valve 15,16,17,18,19,23,25
three-way changeover valve 22
charge conduit 31
packing 32
inside vessel 33
siphon pipe 34
funnel piece 35
liquid level detector 40,41,42,43
temperature gauge 44,45,46,47
collector conduit 50
discharge conduit 51
delivery conduit 52,53
supply conduit 54
branch conduit 55
admission conduit 56
space separating wall portion 60
rise duct 61
gradient duct 62
siphon trap 63
vapour baffle plate 64
duct extension 65
deflecting plate 66
precooking compartment 70, 72, 80
upper stage compressor 74
lower stage compressor 75
intermediate cooler 76
liquid level controller 77
upper stage evaporator 78
lower stage evaporator 79
throttle or feed valve 81, 82
vapour inlet VI
liquid outlet LO

We claim:

1. A method for reducing, in an energy saving manner, the temperature in confined spaces or of products stored in such spaces, by circulating and quasi-continuously cooling an evaporable liquid coolant by means of its limited expansion, in an apparatus comprising, within the path of an induced flow of the evaporable liquid coolant, at least one compressor, a condenser, a liquid collector, at least one evaporator, at least one precooling compartment, and a device for cooling the liquid coolant by means of its limited expansion, said device having a vapour inlet that is connectable to an admission inlet of said at least one compressor, and a liquid outlet that is, directly and/;or indirectly, connectable to a liquid coolant inlet of said at least one evaporator, said method comprising utilizing for cooling, at least temporarily, the cooled liquid coolant as a liquid heat carrier, by causing at least a partial amount of the coolant to flow, by maintaining its liquid state, i.e., without evaporation, through at least one heat exchanger, that is arranged in direct heat exchanging relation to the at least one precooling compartment of the apparatus.

2. The method as claimed in claim 1, and further comprising operating said device for cooling the liquid coolant by means of its limited expansion in a quasi-continuous mode of operation, introducing the cooled flow of coolant in the at least one evaporator of the apparatus, and/or causing at least a partial amount of the cooled liquid coolant to flow, without evaporation through the at least one heat exchanger that is arranged in the flow path of circulation of the liquid coolant within said device for cooling the liquid coolant.

3. The method as claimed in claim 2, and further comprising introducing the cooled liquid coolant, in counterflow and without evaporation, in at least one further heat exchanger that is arranged at a location prior to the at least one evaporator, in the flow path of induced circulation of the coolant within the apparatus.

4. A device for cooling a circulated liquid coolant, in a quasi-continuous mode of operation by means of its limited expansion, said device comprising liquid recipients and a piston-type reciprocating positive displacement pump an admission inlet of which is, via a phase separator, connectable to said liquid recipients, and a delivery outlet of which is connected to the vapour receiving upper space of a condenser to a liquid collector, said device further comprising closing valves, pressure controlled check valves, liquid level detectors and temperature gauges for controlled automatic operation of the device, said device being characterized in comprising two identical liquid recipients of vertically elongated shape and parallel arrangement, the upper inner space sections of which are, via controlled closing valves, alternately connectable to an upper vapour phase section of the phase separator, that is also connected, via a controlled closing valve, to a collector conduit of the liquid collector, said upper inner space sections of the liquid recipients being, via further controlled closing valves, also alternately connectable to a common supply conduit which in turn is, via a three-way changeover valve, also connected to said collector conduit of the liquid collector, the lower inner space sections of the liquid recipients being connected, alternately again, via check valves to a common discharge conduit that leads to a cold liquid outlet of the device, the liquid recipients being further and alternately connected, via further check valves, to a lower liquid phase section of the phase separator, an uppermost vapour outlet of the phase separator being connected to an admission conduit of the at least one reciprocating positive displacement pump, while said admission conduit is further connected, via a check valve, to a vapour inlet of the device, the discharge outlet of the at least one reciprocating positive displacement pump being connected either directly or via a check valve to a delivery conduit of the condenser, or via a controlled closing valve, to a delivery conduit of a lower stage compressor of the apparatus and, via a check valve to both, the delivery conduit of the condenser and the delivery outlet of a higher stage compressor, the device being further characterized in that the common discharge conduit of the liquid recipients is also connected, via a coolant pump, a heat exchanger, and a controlled closing valve, to the three-way changeover valve so that in typical modes of operation, the positive circulation of the liquid coolant within the device is allowed for.

5. The device as claimed in claim 4, and further comprising an intermediate liquid storage vessel of vertically elongated shape, an upper inner space section of said vessel being connected to the collector conduit of the liquid collector while a bottom space section of the vessel is connected, via a branch conduit, to the path of flow of the liquid coolant at a location between the at least one heat exchanger and the three-way changeover valve, and said intermediate liquid storage vessel being equipped with at least one temperature gauge.

6. The device as claimed in claim 5, and further comprising an intermediate liquid storage vessel having the shape of a vertically elongated body of rotation, said vessel having a bottom in/outlet and an upper in/outlet for the liquid coolant, said in/outlets being arranged in axial alignment with the vertical axis of said body of rotation.

7. The device as claimed in claim 6 said intermediate liquid storage vessel also comprising built-in deflecting plates for preventing the rapid mixing of the flowing-in liquid coolant with the liquid already contained in the vessel, said deflecting plates being arranged in axial alignment with the vertical axis of said body of rotation, inside said vessel in the proximity of both, said bottom in/outlet and upper in/outlet.

8. The device as claimed in claim 5, said device having a phase separator of controlled liquid level and the shape of a vertically elongated body of rotation, said phase separator being equipped with at least one liquid level detector and further comprising, in its lower liquid phase section, a packing of Raschig rings for preventing the rapid mixing of the charging-in coolant with the liquid already contained therein.

9. The device as claimed in claim 5, said device having a phase separator of controlled liquid level and the shape of a vertically elongated body of rotation, said phase separator being equipped with liquid level detectors, said phase separator further having, arranged in an inside space between and below said liquid level detectors, a means for preventing the rapid mixing of the charging-in coolant with the liquid already contained therein, said means comprising an inside vessel, an upper inlet of which is equipped with a siphon pipe that protrudes, down to a location near the vessel bottom, into said inside vessel, and said means also comprising, at least optionally, a funnel piece that is arranged between a discharge opening of a charge conduit and said upper inlet of said inner vessel, preferably in axial alignment with the vertical axis of said body of rotation.

10. The device as claimed in claim 5, said device having liquid recipients that are equipped with inside means for inducing and maintaining an increased circulation of the liquid coolant within said liquid recipients during its cooling by limited expansion, said means comprising at least one space separating wall portion whereby at least one rise duct for the upward flow, and at least one gradient duct for the downward flow of the coolant in the inner space of each liquid recipient is substantially provided for.

11. The device as claimed in claim 4, and further comprising having liquid recipients that are equipped with inside means for inducing and maintaining an increased circulation of the liquid coolant within said liquid recipients during its cooling by limited expansion, said means comprising at least one space separating wall portion whereby at least one rise duct for the upward flow, and at least one gradient duct for the downward flow of the coolant in the inner space of each liquid recipient is substantially provided for.

12. The device as claimed in claim 11, said means having a space separating wall portion that is not or only partially connected to the inner wall of the liquid recipient, the at least one rise duct and/or at least one gradient duct being confined, at least partially, by at least one inner wall portion of the liquid recipient, and said at least one rise duct and/or at least one gradient duct having, when viewed in cross section, the shape of a circular ring or a sector.

13. The device as claimed in claim 11, said at least one space separating wall portion of said means being equipped, attached to its upper wall surface, with a number of siphon traps.

14. The device as claimed in any one of the claims 11 to 13, said means being equipped with at least one vapour baffle plate that is arranged, in a substantially horizontal plane, in the proximity of the upper edge of said at least one rise duct.

15. The device as claimed in claim 11, said gradient duct of said means having a duct extension that provides a double inlet for the coolant, said duct extension being attached to said gradient duct and protruding in upward direction from the space separating wall portion.

16. The device as claimed in claim 11 said liquid recipients having the shape of a vertically elongated body of rotation and also comprising built-in deflecting plates for preventing the rapid mixing of the flowing-in liquid coolant with the liquid already contained therein, said deflecting plates being arranged inside said liquid recipients in axial alignment with the vertical axis of said body of rotation.

17. The device as claimed in claim 12, wherein said at least one space separating wall portion of said means is equipped, attached to its upper wall surface, with a number of siphon traps.

18. The device as claimed in claim 12, wherein said liquid recipients of the shape of a vertically elongated body of rotation also comprise built-in deflecting plates for preventing the rapid mixing of the in-flowing liquid coolant with the liquid already contained therein, said deflecting plates being arranged inside said liquid recipients in axial alignment with the vertical axis of said body of rotation.

19. The device as claimed in any one of the claims 4 to 7, and further comprising having a phase separator of controlled liquid level and the shape of a vertically elongated body of rotation, said phase separator being equipped with at least one liquid level detector and further comprising, in its lower liquid phase section, a packing of Raschig rings for preventing the rapid mixing of the charging-in coolant with the liquid already contained therein.

20. The device as claimed in any one of the claims 4 to 7, and further comprising having a phase separator of controlled liquid level and the shape of a vertically elongated body of rotation, said phase separator being equipped with liquid level detectors, said phase separator further having, arranged in an inside space between and below said liquid level detectors, a means for preventing the rapid mixing of the charging-in coolant with the liquid already contained therein, said means comprising an inside vessel, and said means also comprising, at least optionally, a funnel piece that is arranged between a discharge opening of a charge conduit and said upper inlet of said inner vessel, in axial alignment with the vertical axis of said body of rotation.

* * * * *